US010618324B2

(12) United States Patent
Koike et al.

(10) Patent No.: US 10,618,324 B2
(45) Date of Patent: Apr. 14, 2020

(54) PRINTING APPARATUS

(71) Applicant: SEIKO EPSON CORPORATION, Tokyo (JP)

(72) Inventors: Yoshikazu Koike, Nagano (JP); Satoshi Chiba, Nagano (JP); Masanori Nakata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/142,375

(22) Filed: Sep. 26, 2018

(65) Prior Publication Data

US 2019/0023035 A1 Jan. 24, 2019

Related U.S. Application Data

(63) Continuation of application No. 15/396,898, filed on Jan. 3, 2017, now abandoned.

(30) Foreign Application Priority Data

Jan. 20, 2016 (JP) ..... 2016-008827

(51) Int. Cl.
*B41J 13/00* (2006.01)
*B41J 11/00* (2006.01)

(52) U.S. Cl.
CPC ..... *B41J 13/0009* (2013.01); *B41J 11/007* (2013.01)

(58) Field of Classification Search
USPC ..... 399/302; 347/16
See application file for complete search history.

(56) References Cited

U.S. PATENT DOCUMENTS 6,061,543 A * 5/2000 Kayahara ..... G03G 15/167 399/298
6,256,461 B1 * 7/2001 Takeyama ..... G03G 15/1605 399/302
2007/0127954 A1 6/2007 Kojima
(Continued)

FOREIGN PATENT DOCUMENTS

JP 07-053082 A 2/1995
JP 2005-170624 A 6/2005
JP 2007-276970 A 10/2007
(Continued)

*Primary Examiner* — Lam S Nguyen
(74) *Attorney, Agent, or Firm* — Global IP Counselors, LLP

(57) ABSTRACT

A printing apparatus includes a plurality of belt rollers that rotate, a direction in which a rotation axis of each belt rollers extends being a width direction that intersects a transport direction of a medium; a transporting belt that, while wound across the plurality of belt rollers, rotate to transport the medium in the transport direction; a print head that performs printing on the medium transported by the transporting belt; and a control unit that rotates the transporting belt while in a state in which an unrotated state of the transporting belt has continued for a predetermined period. When a rotation position of the transporting belt after application of power and before rotating the transporting belt is referred to as an initial rotation position, in a case in which a rotation of the transporting belt is to be stopped, the control unit stops the transporting belt at a rotation position that is different from the initial rotation position.

4 Claims, 6 Drawing Sheets

(56) References Cited

U.S. PATENT DOCUMENTS

2007/0296751 A1* 12/2007 Ono ..... B41J 11/0005
347/16
2013/0113869 A1 5/2013 Kobayashi et al.

FOREIGN PATENT DOCUMENTS

JP 2012-218354 A 11/2012
JP 2013-095119 A 5/2013

* cited by examiner

PRINTING APPARATUS

CROSS-REFERENCE TO RELATED APPLICATIONS

This application is a continuation application of U.S. patent application Ser. No. 15/396,898 filed on Jan. 3, 2017. This application claims priority to Japanese Patent Application No. 2016-008827 filed on Jan. 20, 2016. The entire disclosures of U.S. patent application Ser. No. 15/396,898 and Japanese Patent Application No. 2016-008827 are expressly incorporated herein by reference.

BACKGROUND

Technical Field

The present invention relates to a printing apparatus, such as an ink jet printer.

Related Art

Hitherto, a printing apparatus is known that includes belt rollers, a direction in which a rotation axis of each belt rollers extends being a width direction that intersects a transport direction of a medium; a transporting belt that, while wound across the plurality of belt rollers, rotate to transport the medium; and a print head that performs printing on the medium transported by the transporting belt (JP-A-2013-95119, for example).

Incidentally, in the printing apparatus described above, while the transporting belt is wound across the belt rollers, a tension acts on the transporting belt such that the transporting belt rotates in a smooth manner when the belt rollers are driven.

Accordingly, when a state in which there is no change in the relative positional relationship between the transporting belt and the belt rollers continues due to not using the printing apparatus for a long period of time, in some cases, curls may be formed at the portions in the transporting belt wound across the belt rollers. In such a case, when transporting the medium with the transporting belt, since the orientation of the medium changes at the portions of the transporting belt where the curls have been formed, degradation in the quality of printing performed on the medium may disadvantageously occur.

SUMMARY

An advantage of some aspects of the invention is that a printing apparatus is provided that is capable of suppressing degradation in print quality when performing printing on a medium transported by a transporting belt.

Hereinafter, a printing apparatus addressed to solve the above problems and effects thereof will be described.

A printing apparatus that solves the above issues according to one embodiment includes a plurality of belt rollers that rotate, a direction in which a rotation axis of each belt rollers extends being a width direction that intersects a transport direction of a medium; a transporting belt that, while wound across the plurality of belt rollers, rotate to transport the medium in the transport direction; a print head that performs printing on the medium transported by the transporting belt; and a control unit that, while in a state in which an unrotated state of the transporting belt has continued for a predetermined period, rotates the transporting belt. When a rotation position of the transporting belt after application of power and before rotating the transporting belt is referred to as an initial rotation position, in a case in which a rotation of the transporting belt is to be stopped, the control unit stops the transporting belt at a rotation position that is different from the initial rotation position.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an exemplary embodiment of a printing apparatus will be described with reference to the drawings. Note that the printing apparatus of the present exemplary embodiment is an ink jet printer that forms characters and images by ejecting ink onto a medium such as a sheet of paper.

Figure 1:
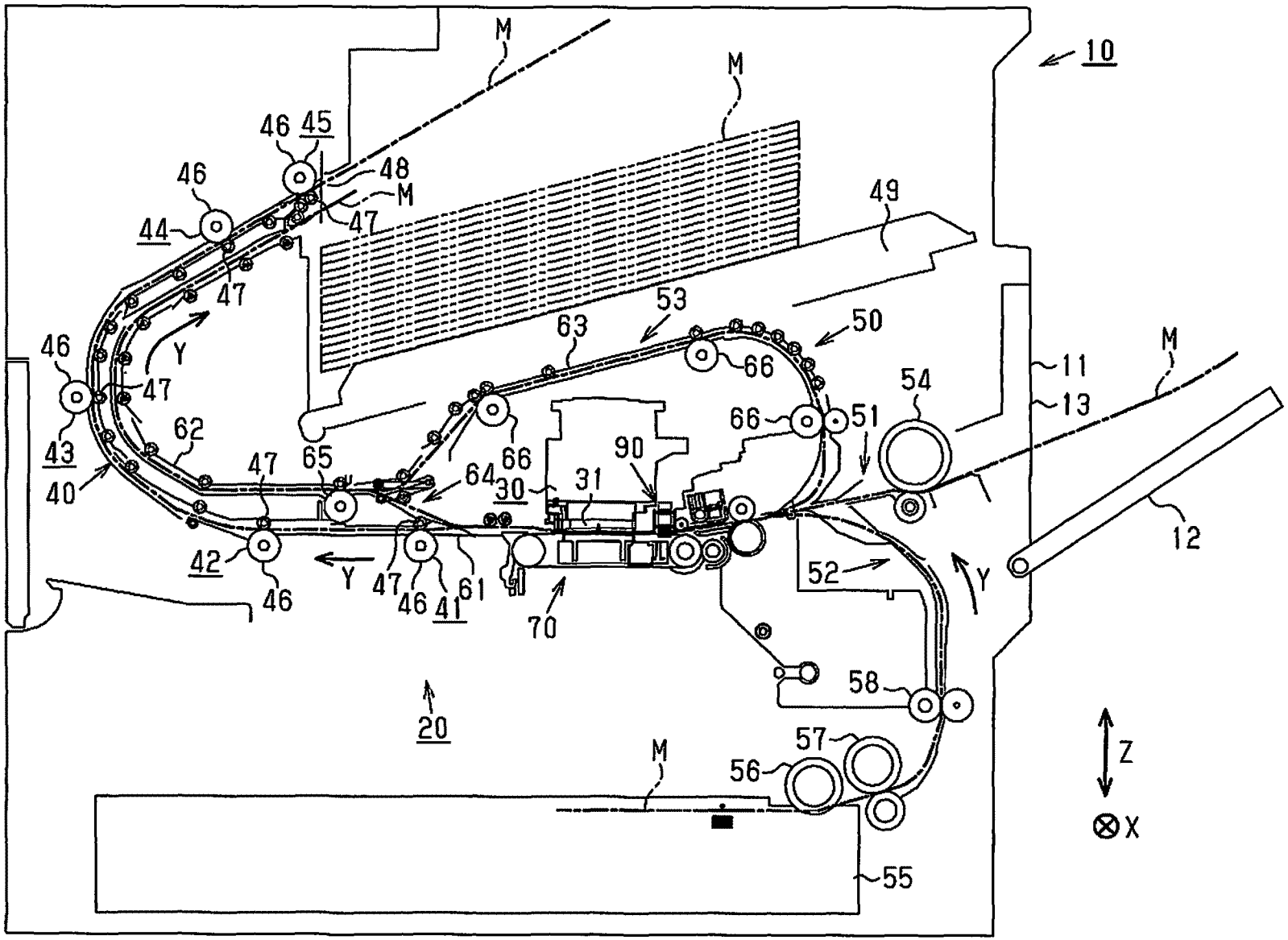
FIG. 1 is a side view illustrating a schematic configuration of a printing apparatus according to an exemplary embodiment.

As illustrated in FIG. 1, a transporting device 20 that transports a medium M along a transport path, and a printing unit 30 that performs printing on the transported medium M are provided inside a housing 11 of a printing apparatus 10 of the present exemplary embodiment. When a direction orthogonal to the sheet surface of FIG. 1 is a width direction X of the medium M, the transport path is formed so as to transport the medium M in a direction intersecting (orthogonal to) the width direction X of the medium M.

Note that in the description hereinafter, a direction in which the medium M is transported is referred to as a "transport direction Y", and the vertical direction is referred to as a "vertical direction Z". Note that the transport direction Y is a direction that intersects (orthogonal to) the width direction X, and the vertical direction Z is a direction that intersects (orthogonal to) the width direction X. Furthermore, a direction opposite to the transport direction Y is also referred to as upstream in the transport direction, and the transport direction Y is also referred to as downstream in the transport direction.

The printing unit 30 includes a line-head type print head 31 that is capable of simultaneously ejecting ink, which is an example of a color material, onto substantially the whole area of the medium M in the width direction X. Furthermore, printing on the print surface of the medium M is performed by having the ink ejected from nozzles 32 (see FIG. 2) formed in the print head 31 adhere onto the medium M. Note that in a print head 31 that is capable of ejecting a plurality of colors of ink, nozzle rows each formed of a plurality of nozzles 32 that eject the same colored ink are formed in the width direction X, such that nozzle rows each ejecting different colored ink are arranged in the transport direction.

The transporting device 20 includes a discharge mechanism portion 40 that discharges the medium M, on which printing has been performed, to the outside of the housing 11, and a feed mechanism portion 50 that feeds the medium M before printing along the transport path. Note that the discharge mechanism portion 40 is provided on the downstream side in the transport direction, and the feed mechanism portion 50 is provided on the upstream side in the transport direction.

The discharge mechanism portion 40 includes a plurality of discharge rollers 41, 42, 43, 44, and 45 arranged along the transport path. The discharge rollers 41 to 45 each include a driving roller 46 that applies, by rotational drive, transporting force to the medium M, and a driven roller 47 that is driven and rotated upon transportation of the medium M. The rotation axis of each of the driving roller 46 and the driven roller 47 extends in the width direction X, and each driven roller 47 is biased towards the corresponding driving roller 46. Furthermore, while the cross-sectional shape of each driving roller 46 intersecting the width direction X is a round shape, the cross-sectional shape of each driven roller 47 intersecting the width direction X is substantially a star shape. In other words, since each driven roller 47 is a roller that comes into contact with the surface of the medium M on which printing has been performed, the shape thereof is formed so that the contact surface area is small to the extent possible.

Furthermore, the medium M transported by the discharge mechanism portion 40 is discharged to the outside of the housing 11 through a discharge port 48 formed in the housing 11. In other words, the discharge port 48 is the downstream end of the transport path, or is the portion most downstream of the transport path. Furthermore, the medium M discharged from the discharge port 48 is, as illustrated by a two-dot chain line in FIG. 1, mounted on a mounting table 49 in a stacked state.

The feed mechanism portion 50 includes a first medium feeding portion 51, a second medium feeding portion 52, a third medium feeding portion 53, and an electrostatic transportation unit 70. The first medium feeding portion 51, the second medium feeding portion 52, and the third medium feeding portion 53 transport the medium M towards the electrostatic transportation unit 70, and the electrostatic transportation unit 70 transport the medium M towards the discharge mechanism portion 40.

A cover 12 that is capable of being opened and closed is provided on one lateral surface (a surface on the right side in FIG. 1) of the housing 11, and an insertion port 13 becomes exposed by opening the cover 12. The first medium feeding portion 51 includes a first feed roller 54 that pinches the medium M inserted into the housing 11 through the insertion port 13. Furthermore, rotation of the first feed roller 54 transports the medium M towards the electrostatic transportation unit 70.

Furthermore, a feed cassette 55 on which the medium M before printing is set in a stacked state is provided at a lower portion of the housing 11. The second medium feeding portion 52 is a supply portion for feeding the medium M from the feed cassette 55. In other words, the second medium feeding portion 52 includes a pickup roller 56 that sends out the uppermost medium M inside the feed cassette 55 to the outside of the feed cassette 55, a separating roller 57 that prevents a plurality of mediums M lying on top of each other from being transported together, and a second feed roller 58 that pinches a single piece of medium M that has passed through the separating roller 57. Furthermore, rotation of the pickup roller 56, the separating roller 57, and the second feed roller 58 transports the medium M towards the electrostatic transportation unit 70.

The third medium feeding portion 53 is a supplying portion for guiding, to the electrostatic transportation unit 70 again, the medium M on which printing has been performed on one side when performing double-side printing, which performs printing on both sides of the medium M. The third medium feeding portion 53 includes, downstream in the transport direction with respect to the electrostatic transportation unit 70, a branch mechanism 64 that switches the transport path of the medium M between a first transport path 61 extending to the discharge port 48 and a second transport path 62 that branches off from the first transport path 61. Furthermore, in the third medium feeding portion 53, a branch transport roller 65 is provided in the second transport path 62, and a plurality of inversion transport rollers 66 are provided in a third transport path 63 that branches off from the second transport path 62.

Furthermore, when a double-side printing is performed, the medium M in which the surface on one side has been printed is guided to the second transport path 62 from the electrostatic transportation unit 70 with the branch mechanism 64. In so doing, the medium M is transported downstream in the transport direction with the rotation of the branch transport roller 65 in the normal direction. Subsequently, when the rear end of the medium M is guided to the second transport path 62, the branch transport roller 65 is rotated in the reverse direction such that the medium M is transported in the reverse direction. The medium M is then guided to the third transport path 63 positioned above the printing unit 30 in FIG. 1, and the medium M is transported along the third transport path 63 upon rotation of the plurality of inversion transport rollers 66. With the above, the medium M joins the first transport path 61 at a portion upstream of the electrostatic transportation unit 70 in the transport direction, and the medium M is guided to the electrostatic transportation unit 70 again.

As described above, when the medium M is guided to the electrostatic transportation unit 70 once more, the printed surface comes into contact with the electrostatic transportation unit 70 such that the non-printed surface faces the print head 31. Note that in the description hereinafter, among the two surfaces of the medium M, the surface that comes into contact with the electrostatic transportation unit 70 is also referred to as a "back surface Ma" and the surface on the opposite side of the back surface Ma is also referred to as a "print surface Mb".

Furthermore, in the printing apparatus 10 of the present exemplary embodiment, the third medium feeding portion 53 constitutes an "inversion mechanism" that inverts the front and back of the medium M such that, after a first surface among the two surfaces of the medium M has been printed as the print surface Mb, a second surface becomes the print surface Mb, and that guides the medium M to the electrostatic transportation unit 70.

Figure 2:
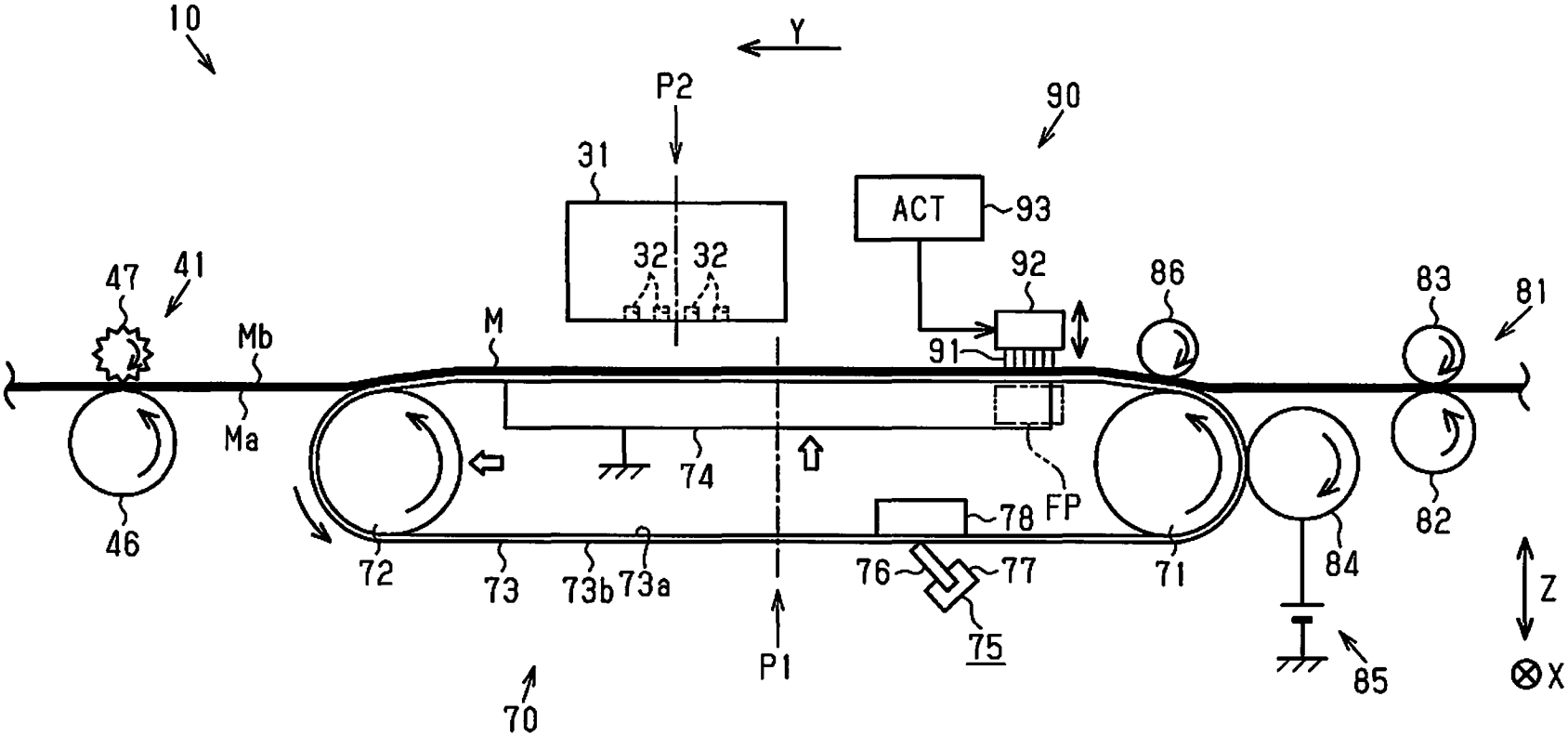
FIG. 2 is a side view illustrating a schematic configuration of an electrostatic transportation unit of the printing apparatus described above.

Referring next to FIG. 2, configurations of the electrostatic transportation unit 70 and peripheral members thereof will be described.

As illustrated in FIG. 2, in the electrostatic transportation unit 70, a first belt roller 71 is disposed upstream of the print head 31 in the transport direction, and a second belt roller 72 is disposed downstream of the print head 31 in the transport direction. The direction in which the rotation axis of each of the first belt roller 71 and the second belt roller 72 extends is the width direction X. Furthermore, the first belt roller 71 is a roller that is connected to a driving source (not shown) and is capable of being rotationally driven, and the second belt roller 72 is a roller that is not connected to a driving force and is not capable of being rotationally driven.

Furthermore, an endless (annular) transporting belt 73 is wound across the first belt roller 71 and the second belt roller 72. The transporting belt 73 is configured of a rubber material or a resin material that has elasticity. Note that as illustrated by a hollow arrow in FIG. 2, the second belt roller 72 is biased in the direction (leftwards in the drawing) away from the first belt roller 71. Accordingly, owing to the second belt roller 72, a tension acts on the transporting belt 73 in the rotating direction of the transporting belt 73.

Furthermore, in the present exemplary embodiment, the print head 31 is disposed at a position downstream in the transport direction with respect to a middle position P1 of the transporting belt 73 in the transport direction Y. Specifically, the center position of the print head 31 in the transport direction Y, in other words, a center position P2 of a nozzle formation area of the print head 31 in the transport direction Y, is positioned downstream of the middle position P1 of the transporting belt 73 in the transport direction.

Furthermore, by having the first belt roller 71 be rotationally driven, the transporting belt 73 is rotated and the medium M is transported in the transport direction Y. Note that when the transporting belt 73 transports the medium, the outer surface of the transporting belt 73 comes into contact with the back surface Ma of the medium M and functions as a support surface that supports the medium M.

In the description hereinafter, the surface of the transporting belt 73 that comes into contact with the first belt roller 71 and the second belt roller 72 is referred to as an "inner surface 73*a*", and the surface of the transporting belt 73 that comes into contact with the back surface Ma of the medium M when supporting the medium M is referred to as an "outer surface 73*b*". Furthermore, the route in which the transporting belt 73 moves when the transporting belt 73 rotates is also referred to as a "circulating route".

As illustrated in FIG. 2, a backup plate 74 that supports the transporting belt 73 by being in contact with the inner surface of the transporting belt 73 is provided immediately below the print head 31 and inside the circulating route of the transporting belt 73. Desirably, the backup plate 74 is configured of an electrically conductive material such as, for example, metal, and is grounded. Furthermore, as illustrated by a hollow arrow in FIG. 2, the backup plate 74 biases the transporting belt 73 to the print head 31 side. Accordingly, owing to the backup plate 74, a tension acts on the transporting belt 73 in the rotating direction of the transporting belt 73. Such as above, in the present exemplary embodiment, the backup plate 74 corresponds to an example of a "belt support".

As illustrated in FIG. 2, a wiping unit 75 that wipes the outer surface 73*b* of the transporting belt 73 is provided vertically below the transporting belt 73. The wiping unit 75 includes a cleaning blade 76 that comes in contact with the outer surface 73*b* of the transporting belt 73, and a blade support 77 that supports the cleaning blade 76.

The cleaning blade 76 is, for example, formed of a resin material, such as a polyethylene terephthlate (PET) film, and has a length that is substantially the same as the length of the transporting belt 73 in the width direction X. The blade support 77 supports the cleaning blade 76 so that the cleaning blade 76 is capable of being biased against the outer surface 73*b* of the transporting belt 73, which is wound across the first belt roller 71 and the second belt roller 72, towards the inside of the transporting belt 73. Furthermore, upon rotation of the transporting belt 73, the wiping unit 75 slides against the outer surface 73*b* of the transporting belt 73 and wipes the outer surface 73*b* of the transporting belt 73 in the route of the circulating route of the transporting belt 73 that is not the transport path of the medium M.

Note that the blade support 77 may be capable of being moved up and down so as to change the gap with the transporting belt 73. With the above, the contact pressure of the cleaning blade 76 against the transporting belt 73 can be changed, and the cleaning blade 76 can be brought into a non-contact state with the transporting belt 73.

Furthermore, a holding portion 78 that pinches the transporting belt 73 together with the wiping unit 75 is provided at a position facing the wiping unit 75 with the transporting belt 73 in between. The holding portion 78 is provided so as to extend along the inner surface 73*a* while being in contact with the inner surface 73*a* of the transporting belt 73 that is biased by the wiping unit 75. Accordingly, when the wiping unit 75 is wiping the transporting belt 73, the holding portion 78 pinches the transporting belt 73 together with the wiping unit 75 in the width direction X.

As illustrated in FIG. 2, feed rollers 81 that transports the medium M, which has been supplied from the first medium feeding portion 51, the second medium feeding portion 52, or the third medium feeding portion 53, towards the transporting belt 73 is provided upstream of the transporting belt 73 in the transport direction. The feed rollers 81 include a driving roller 82 that applies, by rotational drive, transporting force to the medium M, and a driven roller 83 that is driven and rotated by coming in contact with the transported medium M. The driven roller 83 is biased towards the driving roller 82. Furthermore, the rotation axis of each of the driving roller 82 and the driven roller 83 extends in the width direction X, and the cross-sectional shapes of the driving roller 82 and the driven roller 83 extending in the width direction X are round shapes.

Furthermore, in a rotationally driven state, the feed rollers 81 transport the medium M downstream in the transport direction, and in a state in which the rotation is stopped, the feed rollers 81 do not transport the medium M in the transport direction Y. Specifically, when the feed rollers 81 are in the rotationally driven state, while the driving roller 82 and the driven roller 83 pinch the medium M, the driving roller 82 is rotationally driven; accordingly, the medium M is transported in the transport direction. On the other hand, in the state in which the feed rollers 81 are stopped, the driving roller 82 is not rotated; accordingly, the medium M is not transported in the transport direction Y. Moreover, in the state in which the rotation is stopped, since no gap through which the medium M passes is formed between the driving roller 82 and the driven roller 83, the transportation of the medium M is restricted even when an attempt is made to transport the medium M in the transport direction Y from a portion upstream in the transport direction.

As illustrated in FIG. 2, a charge roller 84 that is an example of a charge unit is provided upstream of the first belt roller 71 in the transport direction (the right side in the drawing). The direction in which the rotation axis of the charge roller 84 extends is the width direction X, and the charge roller 84 is in contact with the outer surface 73*b* of the transporting belt 73. Furthermore, a power supply 85 that applies a direct current voltage to the charge roller 84 is connected to the charge roller 84.

Furthermore, by having the rotation of the first belt roller 71 be transmitted to the charge roller 84 through the transporting belt 73, the charge roller 84 is driven and rotated by the first belt roller 71. In so doing, the charge roller 84 supplies an electric charge to the portion on the outer surface 73*b* of the transporting belt 73 that is in contact with the charge roller 84. Note that in the printing apparatus 10 of the present exemplary embodiment, the charge roller 84 supplies a positive electric charge to the transporting belt 73 such that the outer surface 73*b* of the transporting belt 73 is charged with a positive electric charge.

Furthermore, a support roller 86 that presses the medium M that has been transported to the electrostatic transportation unit 70 against the transporting belt 73 is provided upstream of the print head 31 in the transport direction (the right side in the drawing). The support roller 86 is configured of an electrically conductive material such as, for example, metal, and is grounded. Furthermore, by having the rotation of the first belt roller 71 be transmitted to the support roller 86 through the transporting belt 73, the support roller 86 is driven and rotated by the first belt roller 71.

As illustrated in FIG. 2, a discharging device 90 is provided in the transport direction Y between the support roller 86 and the print head 31. The discharging device 90 includes a discharging unit 92 including a brush 91 that protrudes towards the transporting belt 73, and an operation unit 93 that adjusts the contact pressure of the discharging unit 92 against the transporting belt 73 (the medium M).

It is only sufficient that the brush 91 is formed of a material (a resin material such as a conductive nylon, for example) that is capable of removing an electric charge from the medium M, and is a thread brush. Furthermore, in the present exemplary embodiment, the brush 91 is formed so that, when the brush 91 is in contact with the transporting belt 73 (the medium M), the contact pressure against the transporting belt 73 (the medium M) is uniform in the width direction X.

The operation unit 93 includes a mechanism, such as a solenoid, that is capable of moving the discharging unit 92 in a linear manner. Furthermore, as illustrated by a two-headed arrow in FIG. 2, the operation unit 93 adjusts the contact pressure of the discharging unit 92 against the transporting belt 73 (the medium M) by changing the position of the discharging unit 92. For example, in a case in which the electricity on the print surface Mb of the medium M needs to be removed, the operation unit 93 makes the discharging unit 92 come in contact with the transporting belt 73 at a contact pressure that bends the outer surface of the transporting belt 73. On the other hand, in the operation unit 93, in a case in which there is no need to remove any electricity on the print surface Mb of the medium, the discharging unit 92 is retreated from the transporting belt 73. As described above, since the discharging unit 92 of the present exemplary embodiment creates a pressure (a contact pressure) exerted against the transporting belt 73, the discharging unit 92 can be referred to as a "pressing unit" that presses the outer surface of the transporting belt 73.

Note that as illustrated in FIG. 2, the discharging device 90 (the discharging unit 92) that is described above is disposed on the upstream side of the print head 31 in the transport direction. Accordingly, in the rotating direction of the transporting belt 73, the wiping unit 75 described above may be described as being provided on the opposite side of the print head 31 when viewed from the discharging device 90 (the discharging unit 92), and in the rotating direction of the transporting belt 73, the charge roller 84 may be described as being provided between the wiping unit 75 and the discharging unit 92. Moreover, when the position facing the discharging unit 92 with the transporting belt 73 in between is referred to as a "facing position FP", the backup plate 74 described above may be described as being provided from the facing position FP to a portion downstream of the facing position FP in the transport direction.

Figure 3:
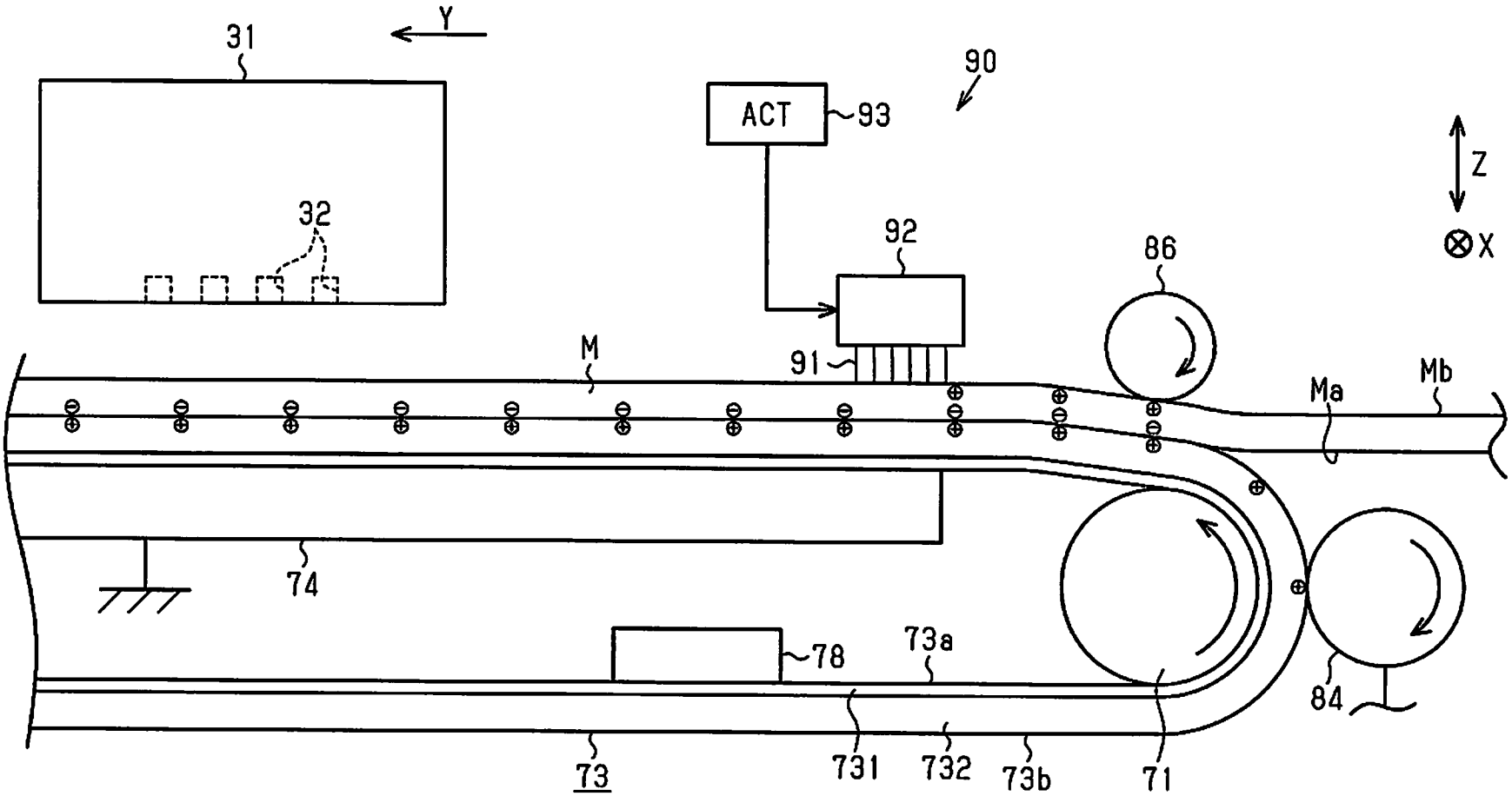
FIG. 3 is a side view schematically illustrating a state in which a medium is electrostatically attracted to a transporting belt.

Referring next to FIG. 3, electrostatic attraction of the medium M to the transporting belt 73 will be described in detail.

As illustrated in FIG. 3, the transporting belt 73 includes an annular conductive layer 731, and an annular insulating layer 732 formed on the outside of the conductive layer 731. The insulating layer 732 is configured to have an electric resistance that is larger than that of the conductive layer 731. Note that an outer surface of the insulating layer 732 is the outer surface 73*b* of the transporting belt 73, and an inner surface of the conductive layer 731 is the inner surface 73*a* of the transporting belt 73.

When the transporting belt 73 is rotated with the rotation of the first belt roller 71, the charge roller 84 is driven and rotated and, accordingly, a positive electric charge (+) is charged on the outer surface 73*b* side of the transporting belt 73, in other words, the outer surface side of the insulating layer 732, and a negative electric charge (−) is charged on the inner surface side of the insulating layer 732.

Furthermore, when the medium M is pushed against the outer surface 73*b* of the transporting belt 73 with the support roller 86, the medium M comes into close contact with the transporting belt 73 and polarization occurs inside the medium M. In other words, while a negative electric charge is charged on the back surface Ma side of the medium M, a positive electric charge is charged on the print surface Mb side that is the side opposite to the back surface Ma of the medium M. Subsequently, the positive electrode charge charged on the print surface Mb side of the medium M is removed by the discharging unit 92 (the brush 91) in contact with the print surface Mb; accordingly, electrostatic attraction force exerted to the medium M from the transporting belt 73 is generated.

In other words, as in the present exemplary embodiment, different from a case in which the transporting belt 73 is alternately charged (AC charged) by a positive electric charge and a negative electrode charge, in a case in which the transporting belt 73 is charged (DC charged) by only a positive electric charge, since areas on the print surface Mb side of the medium M adjacent to each other in the transport direction Y are charged by electric charges with the same polarity, the electric charges in the area adjacent to each other do not become naturally neutralized. Accordingly, an electrostatic attraction force exerted to the medium M from the transporting belt 73 is generated after the electric charge on the print surface Mb of the medium M is removed.

Conversely, there is a case in which the conductive layer 731 of the transporting belt 73 unintentionally becomes frictionally charged when the transporting belt 73 is rotated and the conductive layer 731 of the transporting belt 73 and the backup plate 74 come in slide contact with each other. In such a case, the manner in which the conductive layer 731 is charged affects the manner in which the insulating layer 732 is charged; accordingly, the amount of positive electric charge on the outer surface 73*b* of the transporting belt 73 may, disadvantageously, become decreased.

However, in the case of the printing apparatus 10 of the present exemplary embodiment, since the backup plate 74 is grounded, the conductive layer 731 can be suppressed from being frictionally charged. Accordingly, in the transporting belt 73, the effect that the charged manner of the conductive layer 731 has on the electrostatic attraction force exerted to the medium M from the transporting belt 73 can be suppressed.

As described above, in the present exemplary embodiment, the medium M is transported in the transport direction Y with the rotation of the transporting belt 73 while the transporting belt 73 electrostatically attracts the medium M thereto.

Figure 4:
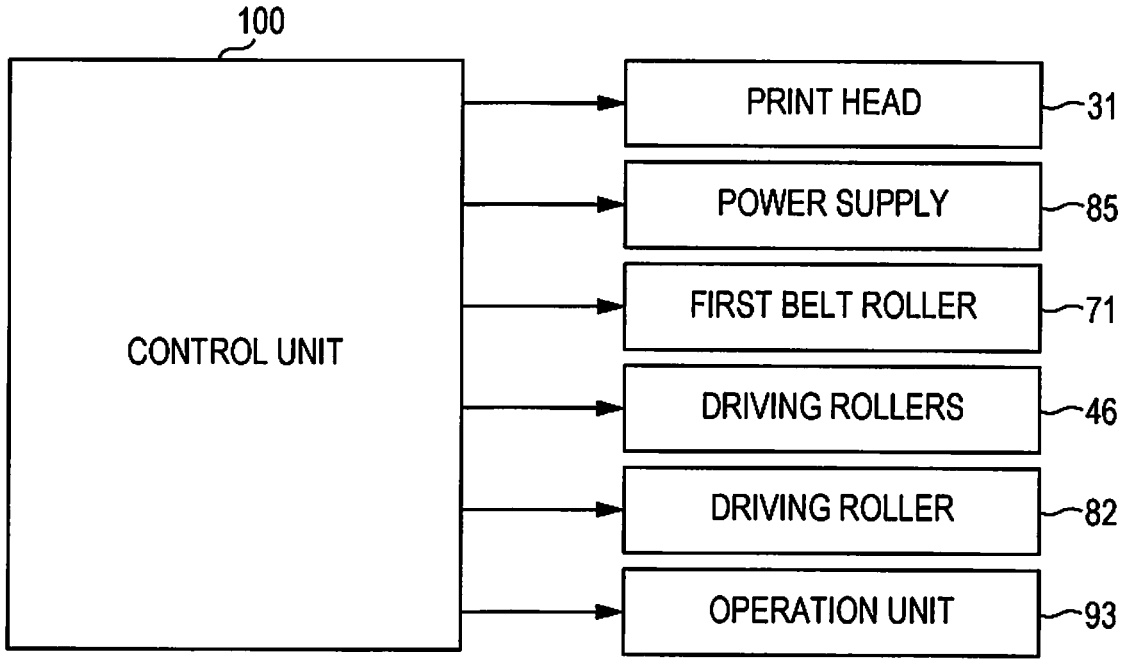
FIG. 4 is a block diagram illustrating an electrical configuration of the printing apparatus described above.

Referring next to FIG. 4, an electrical configuration of the printing apparatus 10 will be described. Note that in FIG. 4, for the sake of ease of description and understanding, the configuration that is the essential portion in describing the effect of the printing apparatus 10 of the present exemplary embodiment is particularly illustrated.

As illustrated in FIG. 4, the printing apparatus 10 includes a control unit 100 that integrally controls each of the components. Furthermore, the print head 31, the power supply 85, the first belt roller 71, the driving roller 82 that constitutes the feed rollers 81, the driving roller 46 that constitutes the discharge roller 41, and the operation unit 93 are connected to an output side interface of the control unit 100.

Furthermore, by driving the components, such as the transporting belt 73, related to the transportation of the medium M, the control unit 100 transports the medium M in the transport direction Y, and by controlling the drive of the print head 31, ejects the ink onto the medium M. In the above described manner, printing is performed on the print surface Mb of the medium M transported in the transport direction Y.

Furthermore, by controlling the drive of the power supply 85, the control unit 100 changes the amount of direct current voltage applied to the charge roller 84. For example, when the direct current voltage applied to the charge roller 84 is increased, the electric charge charged to the transporting belt 73 charged with the charge roller 84 and the electric charge charged to the medium M charged with the transporting belt 73 increase as well. As a result, the electrostatic attraction force exerted to the medium M from the transporting belt 73 becomes larger. In other words, by controlling the drive of the power supply 85, the control unit 100 adjusts the amount of electric charge charged to the charge roller 84 and changes the electrostatic attraction force exerted to the medium M from the transporting belt 73.

Furthermore, by controlling the drive of each of the feed rollers 81, and the first medium feeding portion 51, the second medium feeding portion 52, or the third medium feeding portion 53 that transports the medium M to the feed rollers 81, the control unit 100 performs a skew removing operation that cancels the inclination of the medium M that is transported to the transporting belt 73.

Specifically, while the first medium feeding portion 51, the second medium feeding portion 52, or the third medium feeding portion 53 is transporting the medium M in the transport direction Y, the control unit 100 stops the rotations of the feed rollers 81. By so doing, the medium M is transported in the transport direction Y after the distal end of the medium M comes into contact with the driving roller 82 and the driven roller 83 constituting the feed rollers 81; accordingly, when the medium M is inclined with respect to the transport direction Y, the inclination is cancelled. Subsequently, the control unit 100 rotationally drives the feed rollers 81 so as to allow the medium M, the inclination of which has been cancelled, to be transported towards the transporting belt 73. Such as above, in the present exemplary embodiment, the feed rollers 81 corresponds to an example of a "transport roller".

As illustrated in FIG. 2, in the printing apparatus 10 of the present exemplary embodiment, the transporting belt 73 is wound across the first belt roller 71 and the second belt roller 72 while in a state in which tension is applied thereto so that the transporting belt 73 rotates smoothly when the first belt roller 71 is driven. Accordingly, when a state in which there is no change in the relative positional relationship between the transporting belt 73, and the first belt roller 71 and the second belt roller 72 continues due to not using the printing apparatus 10 for a long period of time, in some cases, curls may be formed at the portions in the transporting belt 73 wound across the first belt roller 71 and the second belt roller 72.

Figure 5:
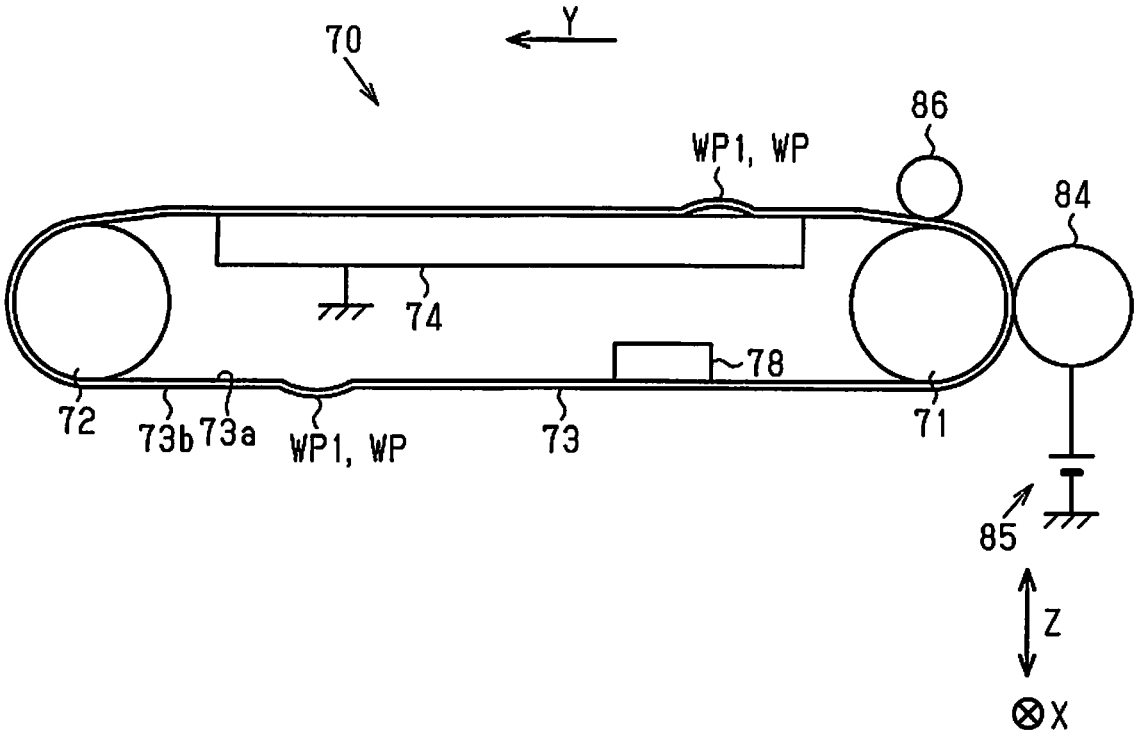
FIG. 5 is a side view illustrating a schematic configuration of an electrostatic transportation unit in which curls have been formed in the transporting belt.

FIG. 5 illustrates a state in which the transporting belt 73 has been slightly rotated after a state in which no change in the relative positional relationship between the transporting belt 73, and the first belt roller 71 and the second belt roller 72 has occurred has continued. As illustrated in FIG. 5, there are cases in which curls bulging out so as to coincide with the external shape of the first belt roller 71 and that of the second belt roller 72 may be formed at the portions in the transporting belt 73 that have been wound across the first belt roller 71 and the second belt roller 72.

Note that in the following description, the portions in the transporting belt 73 wound across the first belt roller 71 and the second belt roller 72 are each referred to as a "wound portion WP", and each wound portion WP at the time when the printing apparatus 10 is powered up is referred to as an "initial wound portion WP1".

Furthermore, in a case in which the initial wound portion WP1 is formed, when the medium M transported with the transporting belt 73 is transported at the initial wound portion WP1, the medium M will rise up from the transport path due the initial wound portion WP1. In such a case, the ejected ink may land on the medium M, which has changed its orientation, at a position different from the normal position and, accordingly, the print quality may be degraded disadvantageously. Furthermore, the medium M that has risen up from the transport path may, disadvantageously, come in contact with the print head 31.

Accordingly, in the present exemplary embodiment, the control unit 100 is configured to rotate the transporting belt 73 when a predetermined condition, which is satisfied when the unrotated state of the transporting belt 73 continues, is satisfied. Note that regarding the manner in which the transporting belt 73 is rotated, it is only sufficient that the transporting belt 73 is rotated by a certain amount (for example, rotated by one third) so that the rotated position of the transporting belt 73 is at a different position with respect to the rotation position of the transporting belt 73 during when the printing apparatus 10 had not been used (hereinafter, also referred to as an "initial rotation position"). Furthermore, regarding the manner in which the transporting belt 73 is rotated, the transporting belt 73 may be continuously rotated. In other words, it is only sufficient that the state in which the initial wound portions WP1 are wound across the first belt roller 71 and the second belt roller 72 does not continue.

Note that in the transporting belt 73 of the present exemplary embodiment, the curls formed in the initial wound portions WP1 gradually becomes smaller as time lapses when the loads, which have been generated in the transporting belt 73 wound around the first belt roller 71 and the second belt roller 72 and which are acting on the initial wound portions WP1, are removed.

Furthermore, the following cases, for example, may be included in the case in which the predetermined condition is satisfied.

First of all, when the printing apparatus 10 is powered up, since the printing apparatus 10 has not been used until the power is applied, there is a high possibility that the unrotated state of the transporting belt 73 has continued. In other words, there is a high possibility that the curls are formed at the initial wound portions WP1 in the transporting belt 73. Accordingly, in the present exemplary embodiment, the control unit 100 determines that the predetermined condition is satisfied when the printing apparatus 10 is powered up.

Furthermore, even if after the printing apparatus 10 has been powered up, there is a possibility of the curls being formed in the initial wound portions WP1 in the transporting belt 73 when the unrotated state of the transporting belt 73 continues for a long period of time. Accordingly, in the present exemplary embodiment, the control unit 100 determines that the predetermined condition is satisfied when the unrotated state of the transporting belt 73 has continued for a specified time after the printing apparatus 10 had been powered up. Note that the specified time may be determined according to the amount of increase in the curls at the wound portions WP with respect to the lapsed time from when the rotation of the transporting belt 73 has been stopped and may be, for example, 10 minutes or an hour.

Furthermore, for example, depending on the material of the transporting belt 73, while the curls may be formed easily at the wound portions WP of the transporting belt 73, the curls may easily become smaller when the load acting on the wound portions WP is removed.

In such a case, there may be a case in which the curls are formed at the wound portions WP after the most recent rotation of the transporting belt 73 has been stopped and until the next printing, based on a print job, is started. Accordingly, in the present exemplary embodiment, in order to make such curls smaller, the control unit 100 may determine that the predetermined condition has been satisfied when a print job is input after the printing apparatus 10 has been powered up. Note that in such a case, the transporting belt 73 is rotated from when the print job has been input until before printing based on the print job is started.

On the other hand, in the printing apparatus 10, there is a concern that the curls at the initial wound portions WP1 do not become smaller but even may become larger if, when printing on the medium M is completed, the power is turned off while the initial wound portions WP1 are wound across the first belt roller 71 and the second belt roller 72.

Accordingly, in the present exemplary embodiment, when the rotation of the transporting belt 73 is stopped, the control unit 100 stops the transporting belt 73 at a rotation position that is different from the initial rotation position. In other words, the control unit 100 of the present exemplary embodiment not only stores the initial rotation position but also determines whether the rotation position of the first belt roller 71 is positioned in the initial rotation position.

Furthermore, as described above, in the medium M, the portion transported by the initial wound portion WP1 of the transporting belt 73 rises up easily compared with the portion that is transported by the portion other than the initial wound portion WP1. Accordingly, in accordance with the position of the initial wound portion WP1 in the rotating direction of the transporting belt 73, the control unit 100 of the present exemplary embodiment adjusts the belt transport start timing that is the timing at which the transporting belt 73 starts the transportation of the medium M. Note that the belt transport start timing is adjusted by controlling the timing at which the feed rollers 81 are switched from a state in which the rotation is stopped to a rotationally driven state.

Figure 6:
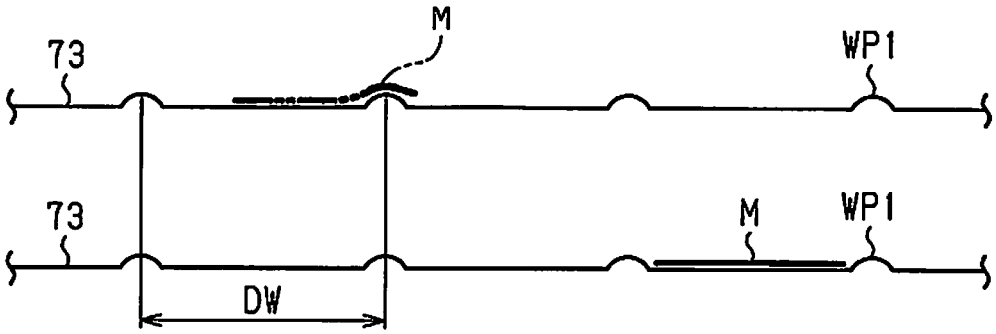
FIG. 6 is a schematic diagram illustrating a state in which a medium having a short length in a transport direction is transported.
Figure 7:
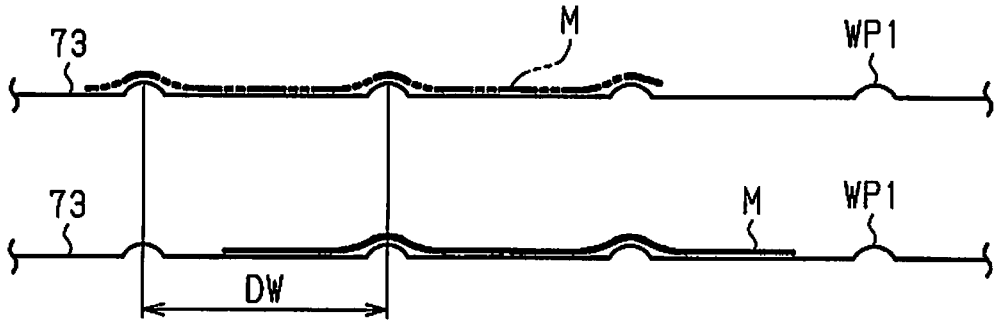
FIG. 7 is a schematic diagram illustrating a state in which a medium having a long length in the transport direction is transported.
Figure 8:
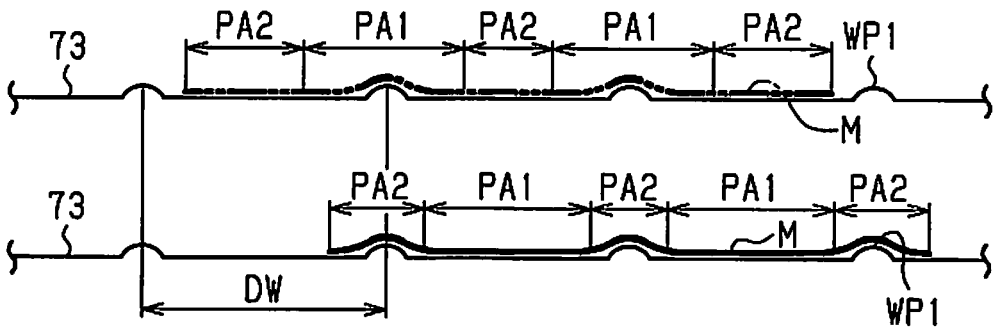
FIG. 8 is a schematic diagram illustrating a state in which a medium having a long length in the transport direction is transported during printing based on a print job that forms print areas and non-printing areas arranged in the transport direction.

Referring next to FIGS. 6 to 8, a specific example of the method for adjusting the belt transport start timing will be described. Note that in FIGS. 6 to 8, time sequential positional relationships between the transport path continuously formed upon rotation of the transporting belt 73 and the medium M are illustrated. Furthermore, in FIGS. 6 to 8, the curls of the initial wound portions WP1 are illustrated in an exaggerated manner for the sake of ease of description and understanding.

As illustrated in FIGS. 6 to 8, since the rotation of the transporting belt 73 transports the medium M in the transport direction Y, the initial wound portions WP1 appear periodically upon rotation of the transporting belt 73 in the route constituting the transport path of the medium M, which is the circulating route of the transporting belt 73. Specifically, as is the case of the present exemplary embodiment, in a case in which the transporting belt 73 is wound across the first belt roller 71 and the second belt roller 72, the initial wound portion WP1 corresponding to the first belt roller 71 and the initial wound portion WP1 corresponding to the second belt roller 72 appear periodically in an alternating manner. Note that in the circulating route of the transporting belt 73, intervals between adjacent initial wound portions WP1 are each referred to as a "reference interval DW".

Incidentally, in the present exemplary embodiment, because the transporting belt 73 is pressed with the backup plate 74, in the rotating direction of the transporting belt 73, the reference interval DW from a first initial wound portion WP1 to a second initial wound portion WP1 is longer then the reference interval DW from the second initial portion WP1 to the first initial wound portion WP1. However, in the following description, for the sake of ease of description and understanding, in the rotating direction of the transporting belt 73, the reference interval DW from the first initial wound portion WP1 to the second initial wound portion WP1 is assumed to be the same in length as the reference interval DW from the second initial portion WP1 to the first initial wound portion WP1.

As illustrated by a two-dot chain line on the upper side of FIG. 6, in a case in which a medium M having a length that is shorter than the reference interval DW in the transport direction Y is printed, if the medium M is transported with the transporting belt 73 so that a portion of the medium M is supported by the initial wound portion WP1, then, a portion of the medium M will rise up from the transport path. Accordingly, in the present exemplary embodiment, as illustrated by a solid line on the lower side of FIG. 6, in a case in which the length of the medium M in the transport direction Y is shorter that the reference interval DW, the control unit 100 adjusts the belt transport start timing so that the medium M is transported to a portion between initial wound portions WP1 that are adjacent to each other in the transport direction Y.

Furthermore, as illustrated by a solid line and a two-dot chain line in FIG. 7, in a case in which a medium M having a length that is equivalent to or longer than the reference interval DW in the transport direction Y is printed, depending on the belt transport start timing, from when the transporting belt 73 starts the transportation of the medium M until when the transportation thereof is ended, the number of the initial wound portions WP1 of the transporting belt 73 that is in contact with the back surface of the medium M may differ. Furthermore, when the number of the initial wound portions WP1 of the transporting belt 73 that is in contact with the back surface of the medium M becomes large, the portions in the medium M that rise up from the transport path tend to increase.

Accordingly, in the present exemplary embodiment, the control unit 100 adjusts the belt transport start timing such that, from when the transporting belt 73 starts the transportation of the medium M until when the transportation thereof is ended, the medium M is transported so that the number of the initial wound portions WP1 of the transporting belt 73 in contact with the back surface Ma of the medium M becomes fewer. In the example illustrated in FIG. 7, the number of the initial wound portions WP1 of the transporting belt 73 that is in contact with the back surface Ma of the medium M is reduced to two times from three times.

Furthermore, as illustrated by a solid line and a two-dot chain line in FIG. 8, depending on the print job input to the printing apparatus 10, there may be a case in which printing in which print areas PA1 and non-printing areas PA2 are formed on the medium M so as to be arranged in the transport direction Y may be performed. In such a case, regardless of the number of initial wound portions WP1 of the transporting belt 73 that is in contact with the back surface Ma of the medium M, in order to suppress degradation in the print quality in the print areas PA1, it is desirable that the portions in the back surface Ma of the medium M where the print areas PA1 are formed are avoided from coming in contact with the initial wound portions WP1. In other words, it is desirable that the portions in the medium M where the print areas PA1 are formed are not transported to the initial wound portions WP1.

Accordingly, in the present exemplary embodiment, at the time when the print job described above is input, the control unit 100 adjusts the belt transport start timing such that, from when the transporting belt 73 starts the transportation of the medium M until when the transportation thereof is ended, the medium M is transported so that the number of the initial wound portions WP1 of the transporting belt 73 in contact with the surface Ma on the opposite side of the print surface Mb on which the print areas PA1 are formed becomes fewer. In the example illustrated in FIG. 8, the number of the initial wound portions WP1 of the transporting belt 73 that is in contact with the surface Ma on the opposite side of the print surface Mb on which the print areas PA1 are formed is reduced to zero (0) times from two times.

Effects of the printing apparatus 10 of the present exemplary embodiment will be described next.

When power is applied to the printing apparatus 10 of the present exemplary embodiment, the transporting belt 73 is rotated. Accordingly, from the time the print job is input until the time printing based on the print job is started, the initial wound portions WP1 are not wounded around the first belt roller 71 and the second belt roller 72. With the above, in a case in which curls have been formed in the initial wound portions WP1, the curls are made smaller until the printing based on the print job is started; accordingly, the degradation in print quality caused by the curls of the initial wound portions WP1 is suppressed.

Furthermore, even when printing is started while in a state in which the curls in the initial wound portions WP1 of the transporting belt 73 have not been completely made small, the timing (the belt transport start timing) at which the medium M is fed to the transporting belt 73 is adjusted in accordance with the positions of the initial wound portions WP1 in the transporting belt 73. Accordingly, degradation in the print quality on the medium M caused by the initial wound portions WP1 of the transporting belt 73 can be suppressed.

Furthermore, when printing is completed, the transporting belt 73 is stopped at a rotation position that is different from the initial rotation position. As in the above manner, the initial wound portions WP1 are not wound around the first belt roller 71 and the second belt roller 72, and the increase in the curls in the initial wound portions WP1 is suppressed.

According to the exemplary embodiment described above, the following effects can be obtained.

(1) In a case in which the predetermined condition, which is satisfied when the unrotated state of the transporting belt 73 continues, is satisfied, since the transporting belt 73 is rotated, initial wound portions WP1 are not wound around the first belt roller 71 and the second belt roller 72. Accordingly, since the state in which the initial wound portions WP1 are wounded around the first belt roller 71 and the second belt roller 72 is not continued, the increase in the curls in the initial wound portions WP1 can be suppressed and the curls in the initial wound portions WP1 can be made smaller. As a result, when printing is performed on the medium M that is transported with the transporting belt 73, degradation in print quality can be suppressed.

(2) When power is applied, since the printing apparatus 10 had not been used until the power had been applied, there is a high possibility that the unrotated state of the transporting belt 73 has continued. However, in the present exemplary embodiment, when power is applied, it is assumed that the predetermined condition is satisfied and the transporting belt 73 is rotated. Accordingly, the increase in the curls in the initial wound portions WP1 can be suppressed and the curls in the initial wound portions WP1 can be made smaller before printing is started.

(3) Even after power has been applied, if no printing is performed and the unrotated state of the transporting belt 73 continues for a long period of time, curls may be formed in the wound portions WP. However, in the present exemplary embodiment, after power is applied, when the unrotated state of the transporting belt 73 continues for a specified time, it is assumed that the predetermined condition is satisfied and the transporting belt 73 is rotated. Accordingly, the increase in the curls in the wound portions WP at the time when the rotation of the transporting belt 73 had been stopped can be suppressed and the curls in the above portions can be made smaller.

(4) Since the transporting belt 73 is rotated when a print job is input, the increase in the curls in the wound portions WP at the time when the print job had been input can be suppressed and the curls in the wound portions WP can be made smaller, by the time the printing based on the print job is started.

(5) When there are curls formed in the initial wound portions WP1, the orientation of the portion of the medium M transported by the initial wound portions WP1 of the transporting belt 73 tends to become more unstable compared with the portion of the medium M that is transported by the portion other than the initial wound portions WP1.

Accordingly, when printing is performed on the former portion of the medium M, the print quality is easily degraded. However, in the present exemplary embodiment, since the belt transport start timing is adjusted in accordance with the positions of the initial wound portions WP1 of the transporting belt 73 in the rotating direction, the medium M can be transported so that the effect that the curls of the initial wound portions WP1 have on the orientation of the medium M is made small. Accordingly, degradation in print quality can be suppressed.

(6) When printing is performed on a medium M having a length in the transport direction Y that is shorter than the reference interval DW, the belt transport start timing is adjusted so that the medium M is transported to a portion between adjacent initial wound portions WP1. Accordingly, printing can be performed on a medium M with a stable orientation.

(7) When printing is performed on a medium M having a length in the transport direction Y that is equivalent to or longer than the reference interval DW, the belt transport start timing is adjusted such that, from when the transporting belt 73 starts the transportation of the medium M until when the transportation thereof is ended, the medium M is transported so that the number of the initial wound portions WP1 of the transporting belt 73 in contact with the back surface of the medium M becomes fewer. Accordingly, since the frequency in which printing is performed on the portion of the medium M supported by the initial wound portion WP1 decreases, the degradation in print quality can be suppressed accordingly.

(8) When a print job that forms, on the medium M, the print areas PA1 and the non-printing areas PA2 that are arranged in the transport direction Y is input, the medium M is transported so that the number of the initial wound portions WP1 of the transporting belt 73 that is in contact with the surface on the opposite side of the print surface Mb on which the print areas PA1 of the medium M are formed is reduced. Accordingly, since the frequency in which printing is performed on the portion of the medium M supported by the initial wound portion WP1 decreases, the degradation in print quality can be suppressed accordingly.

(9) If the transporting belt 73 is stopped at a rotation position that is the same as the initial rotation position, there are concerns that the curls of the initial wound portions WP1 increase and that the curls in the initial wound portion WP1 cannot be made smaller. In the exemplary embodiment, when the transporting belt 73 is stopped, since the transporting belt 73 is stopped at a rotation position that is different from the initial rotation position, the above situation can be averted.

(10) In the present exemplary embodiment, the rising up of the transporting belt 73 can be suppressed by having the discharging unit 92, which is an example of the pressing unit, press the transporting belt 73. Accordingly, even if curls are formed in the initial wound portions WP1, the rising up of the initial wound portions WP1 from the backup plate 74 can be suppressed.

(11) Furthermore, since the pressing unit serves as a discharging unit 92 as well, the device configuration can be simplified, and by removing the electric charge from the print surface Mb of the medium M, the reduction in the electrostatic attraction force exerted to the medium M from the transporting belt 73 can be suppressed.

(12) Since the contact pressure of the discharging unit 92 can be adjusted with the operation unit 93, when there is a need to remove the electric charge from the print surface Mb of the medium M, such as when performing printing on the medium M, the contact pressure can be set high and, on the other hand, when there is no need to remove the electric charge from the print surface Mb of the medium M, such as when printing is not performed on the medium M, the contact pressure can be set low. Accordingly, when there is no need to remove the electric charge from the print surface Mb of the medium M, a state in which the contact pressure is low continues such that deterioration (deformation, for example) of the discharging unit 92 can be suppressed.

(13) Since the wiping unit 75 that wipes the outer surface 73*b* of the transporting belt 73 is provided in the route, among the circulating route of the transporting belt 73, that is not the transport path of the medium M, foreign matter (adhered matter) adhered on the transporting belt 73 can be removed with the wiping unit 75. As in the above manner, the electrostatic attraction force exerted to the medium M from the transporting belt 73 can be suppressed from being decreased by the adhered matter.

(14) In a case in which the wiping unit 75 wipes the outer surface 73*b* of the transporting belt 73, when the transporting belt 73 is displaced in a direction away from the wiping unit 75, a portion in the transporting belt 73 in which neither the transporting belt 73 nor the wiping unit 75 come in contact will be created such that, disadvantageously, the outer surface 73*b* of the transporting belt 73 cannot be wiped in a normal manner. However, in the present exemplary embodiment, when the wiping unit 75 wipes the outer surface 73*b* of the transporting belt 73, the holding portion 78 comes in contact with the inner surface 73*a* of the transporting belt 73 such that the transporting belt 73 is pinched between the wiping unit 75 and the holding portion 78 so as to restrict the transporting belt 73 form being displaced in a direction away from the wiping unit 75. Accordingly, when the wiping unit 75 wipes the transporting belt 73, removal of the adhered matter from the transporting belt 73 can be facilitated.

Note that the exemplary embodiment described above may be modified as follows.

In the exemplary embodiment described above, the control unit 100 may start the rotation of the transporting belt 73 before starting the skew removing operation. With the above, at least the increase in the curls in the wound portions WP at the time when the skew removing operation had been started can be suppressed and the curls of the above portions can be made smaller until the medium M is transported to the print start position with transporting belt 73.

Figure 9:
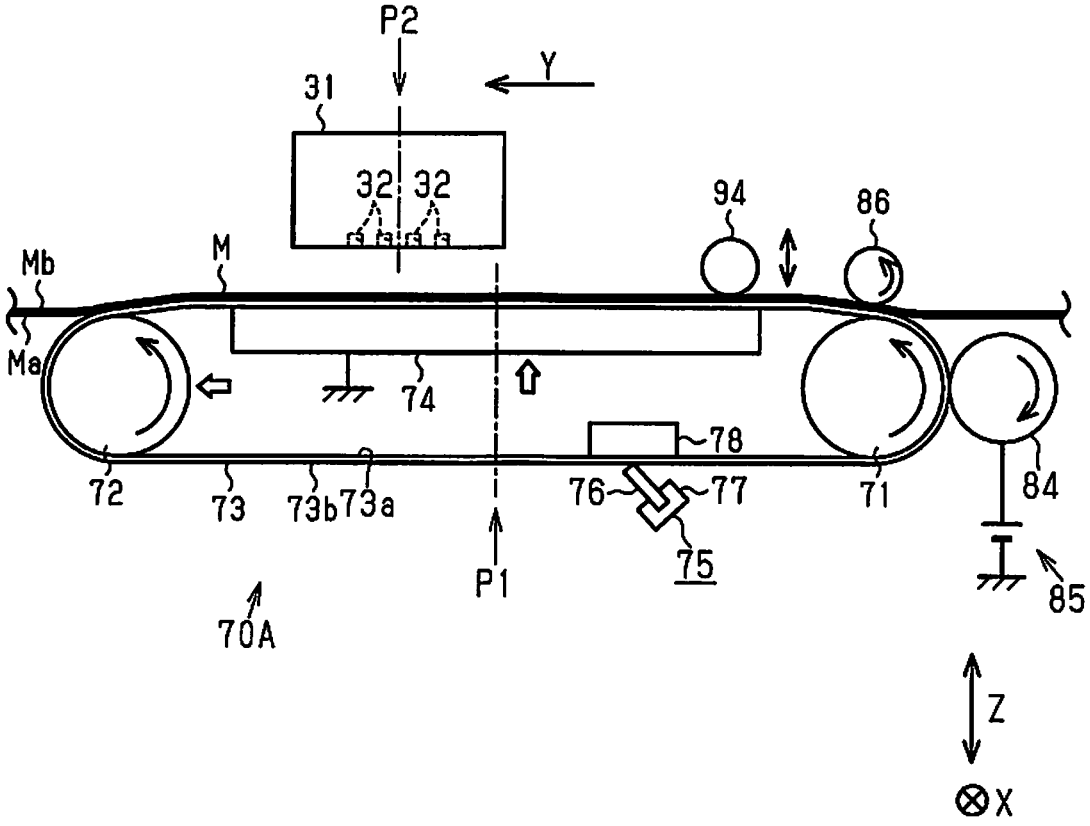
FIG. 9 is a side view illustrating a schematic configuration of an electrostatic transportation unit according to a modification.

The discharging unit 92 does not have to be provided. In such a case, desirably, a pressing unit that presses the outer surface 73*b* of the transporting belt 73 is provided. In such a case, as illustrated in FIG. 9, an electrostatic transportation unit 70A, desirably, includes a pressing roller 94, serving as an example of the pressing unit, in which the direction toward which the rotation axis extends is the width direction X. With the above, since the pressing roller 94 can be rotated upon transportation of the medium M, compared with a configuration in which the pressing unit does not rotate, the friction between the medium M and the pressing roller 94 can be reduced. In other words, the surface of the medium M can be avoided from being easily damaged.

When the time in which the rotation of the transporting belt 73 is stopped is a belt stopped time, the curls of the initial wound portions WP1 become larger as the belt stopped time becomes longer. Accordingly, in the control unit 100 of the exemplary embodiment described above, when the belt stopped time is long, the contact pressure of the discharging unit 92 (the pressing unit) can be set larger than the contact pressure of when the belt stopped time is short. With the above, since the contact pressure becomes lager as the curl becomes lager, the curl can be pressed and be reduced in size regardless of the size of the curl.

When the rotation of the transporting belt 73 is stopped, the control unit 100 may stop the transporting belt 73 at the initial rotation position.

The control unit 100 does not have to adjust the belt transport start timing according to the positions of the initial wound portions WP1 in the rotating direction of the transporting belt 73.

In the exemplary embodiment described above, although a plurality of examples of the predetermined condition for rotating the transporting belt 73 have been described, the transporting belt 73 may be rotated only when either one of the predetermined conditions is satisfied.

The operation unit 93 does not have to be provided. In other words, the contact pressure of the discharging unit 92 against the transporting belt 73 (the print surface Mb of the medium M) does not have to be adjustable.

The discharging unit 92 may be a discharge roller in which the direction toward which the rotation axis extends is the width direction X.

The printing apparatus 10 may be a serial ink jet printer that performs printing by ejecting ink towards a medium M from a print head 31 supported by a carriage that reciprocates in a width direction X.

The transporting belt 73 may be wound across three or more belt rollers.

The wiping unit 75 and the holding portion 78 do not have to be provided.

The backup plate 74 does not have to be formed of an electrically conductive material and does not have to be grounded.

The charge roller 84 (the charge unit) may AC charge the transporting belt 73. In such a case, since the electric charge of the print surface Mb side of the medium M is naturally neutralized, the discharging unit 92 does not have to be provided.

The transporting belt 73 does not have to transport the medium M while electrostatically attracting the medium M thereto. For example, the transporting belt 73 may transport the medium M in a peelable and adhered state, or transport the medium M in a suctioned state.

The recording material used in printing may be a fluid (a liquid, a liquid body formed of a functional material dispersed or mixed in a liquid, a fluid body such as gel, and a solid that can be made to flow and ejected as a fluid) other than ink. For example, recording may be performed by ejecting a liquid body that includes, in a dispersed or dissolved manner, a material such as an electrode material or a color material (a pixel material) that is used to manufacture liquid crystal displays, electroluminescence (EL) displays, and surface emitting displays.

Furthermore, the printing apparatus 10 may be a fluid body ejection apparatus that ejects a fluid body such as gel (physical gel, for example), or a particulate matter ejection apparatus (toner jet recording apparatus, for example) that ejects solid such as, for example, powder (particulate matter) including toner. Note that in the present specification, a "fluid" is a concept that does not include a fluid that is only formed of gas, and a fluid includes, for example, a liquid (an inorganic solvent, an organic solvent, a solution, a liquid resin, a liquid metal (a metallic melt), and the like), a liquid body, a fluid body, and a particulate matter (for example, grain or powder).

As long as the printing apparatus 10 is a printer that heats the medium M, the printing apparatus 10 is not limited to a printer that performs recording by ejecting a fluid, such as ink, and may be, for example, a non-impact printer such as a laser printer, an LED printer, or a thermal transfer printer (including a dye sublimation printer), or may be an impact printer such as dot-impact printer.

The medium M is not limited to paper and may be a plastic film, or a fabric used in a piece of printing equipment, and the like.

As explained above, a printing apparatus according to one embodiment includes a plurality of belt rollers that rotate, a direction in which a rotation axis of each belt rollers extends being a width direction that intersects a transport direction of a medium; a transporting belt that, while wound across the plurality of belt rollers, rotate to transport the medium in the transport direction; a print head that performs printing on the medium transported by the transporting belt; and a control unit that, while in a state in which an unrotated state of the transporting belt has continued for a predetermined period, rotates the transporting belt when a predetermined condition is satisfied.

According to the above configuration, the transporting belt is rotated when the predetermined condition is satisfied by continuation of the unrotated state of the transporting belt. Accordingly, the portions (hereinafter, also referred to as "initial wound portions") of the transporting belt that had been wound around the belt rollers until the transporting belt had been rotated are not wound around the belt rollers. Accordingly, since the state in which the initial wound portions are wounded around the belt rollers is not continued, the increase in the curls in the initial wound portions can be suppressed and the curls in the initial wound portions can be made smaller. As a result, when printing is performed on the medium that is transported with the transporting belt, degradation in print quality can be suppressed.

In the printing apparatus described above, the control unit may determine that the predetermined condition is satisfied when power is applied.

When power is applied, since the printing apparatus had not been used until the power had been applied, there is a high possibility that the unrotated state of the transporting belt has continued. However, in the configuration described above, when power is applied, it is assumed that the predetermined condition is satisfied and the transporting belt is rotated. Accordingly, the increase in the curls in the initial wound portions can be suppressed and the curls in the initial wound portions can be made smaller before printing is started.

In the printing apparatus described above, the control unit may determine that the predetermined condition is satisfied when, after the power has been applied, an unrotated state of the transporting belt has continued for a specified time.

Even after power has been applied, if the unrotated state of the transporting belt continues for a long period of time, curls may be formed in the portions wound around the belt rollers. However, in the configuration described above, after power is applied, when the unrotated state of the transporting belt continues for a specified time, it is assumed that the predetermined condition is satisfied and the transporting belt is rotated. Accordingly, the increase in the curls in the portions wound around the belt rollers can be suppressed and the curls in the portions can be made smaller.

In the printing apparatus described above, the control unit may determine that the predetermined condition is satisfied when, after the power has been applied, a print job is input.

In the configuration described above, when a print job is input, the transporting belt is rotated. Accordingly, the increase in the curls in the portions in the transporting belt wound around the belt rollers at the time when the print job had been input can be suppressed and the curls in the portions can be made smaller, by the time the printing based on the print job is started.

In the printing apparatus described above, during a rotation of the transporting belt in a case in which the predetermined condition has been satisfied, the transporting belt may be rotated such that contact positions in which the transporting belt is in contact with the plurality of belt rollers are different from the contact positions before the rotation. With the above, the transporting belt can be rotated in advance so that the distal end of the transported medium is not positioned at the portion in the transporting belt where the curls have been formed. The above is particularly effective in a case in which a system in which the medium is suctioned to the transporting belt using a certain type of force is employed, since the rising up of the distal end of the medium from the transporting belt can be suppressed.

The printing apparatus described above may further include a transport roller disposed upstream of the transporting belt in the transport direction. In a rotationally driven state, the transport roller may transport the medium downstream in the transport direction, and in a state in which the rotation is stopped, the transport roller may not transport the medium downstream in the transport direction. The control unit may make a skew removing operation be performed, the skew removing operation being an operation in which, after an inclination of the medium against the transport direction is cancelled by having a distal end of the medium come in contact with the transport roller which is in a state in which the rotation is stopped, the transport roller is made to be in a rotationally driven state, and rotates the transporting belt before the skew removing operation is started.

In the configuration described above, the transporting belt is rotated before the skew removing operation is started. Accordingly, by the time the transporting belt transports the medium to the print start position, the increase in the curls in the portions in the transporting belt wound around the belt rollers at the time when the skew removing operation had been started can be suppressed and the curls in the portions can be made smaller.

In the printing apparatus described above, in the transporting belt, when portions in which the plurality of belt rollers are wound around when power is applied are referred to as initial wound portions, the control unit may adjust, in accordance with the positions of the initial wound portions in a rotating direction of the transporting belt, a belt transport start timing in which the transporting belt starts the transportation of the medium.

When there are curls formed in the initial wound portions, the orientation of the portion of the medium transported by the initial wound portions of the transporting belt tends to become more unstable compared with the portion of the medium that is transported by the portion other than the initial wound portions. Accordingly, when printing is performed on the former portion of the medium, there are cases in which the print quality becomes degraded easily. However, in the configuration described above, since the belt transport start timing is adjusted in accordance with the positions of the initial wound portions of the transporting belt in the rotating direction, the medium can be transported so that the effect that the curls of the initial wound portions have on the orientation of the medium is made small. Accordingly, degradation in print quality can be suppressed.

In the printing apparatus described above, when, in a circulating route of the transporting belt, an interval between adjacent initial wound portions is referred to as a reference interval, and in a case in which printing is performed on the medium having a length in the transport direction that is shorter than the reference interval, the control unit may adjust the belt transport start timing such that the medium is transported to a portion between the adjacent initial wound portions.

With the above configuration, since the medium having a length in the transport direction that is shorter than the reference interval can be transported by a portion between the adjacent initial wound portions, the medium can be made to not be transported by the initial wound portions. Accordingly, printing can be performed on a medium with a stable orientation.

In the printing apparatus described above, when, in a circulating route of the transporting belt, an interval between adjacent initial wound portions is referred to as a reference interval, and in a case in which printing is performed on a medium having a length in the transport direction that is equivalent to or longer than the reference interval, the control unit may adjust the belt transport start timing such that, from when the transporting belt starts the transportation of the medium until when the transportation thereof is ended, the medium is transported so that a number of the initial wound portions of the transporting belt in contact with a back surface of the medium becomes fewer.

With the above configuration, when a medium having a length in the transport direction that is equivalent to or longer than the reference interval is transported with the transporting belt, the number of the initial wound portions of the transporting belt in contact with the back surface of the medium can be reduced. Accordingly, since the frequency in which printing is performed on the portion of the medium transported by the initial wound portion decreases, the degradation in print quality can be suppressed accordingly.

In the printing apparatus described above, in a case in which a print job in which a print area and a non-printing area arranged in the transport direction is formed on the medium is input, the control unit may adjust the belt transport start timing such that, from when the transporting belt starts the transportation of the medium until when the transportation thereof is ended, the medium is transported so that a number of the initial wound portions of the transporting belt in contact with a surface on an opposite side of a print surface on which the print area is formed becomes fewer.

With the configuration described above, from when the transporting belt starts the transportation of the medium until when the transportation thereof is ended, the number of the initial wound portions of the transporting belt in contact with the surface on the opposite side of the print surface on which the print area is formed can be reduced. Accordingly, since the frequency in which printing is performed on the portion of the medium transported by the initial wound portion decreases, the degradation in print quality can be suppressed accordingly.

In the printing apparatus described above, when a rotation position of the transporting belt after application of power and before rotating the transporting belt is referred to as an initial rotation position, and in a case in which a rotation of the transporting belt is to be stopped, the control unit may stop the transporting belt at a rotation position that is different from the initial rotation position.

If the transporting belt is stopped at a rotation position that is the same as the initial rotation position, there are concerns that the curls of the initial wound portions increase and that the curls in the initial wound portion cannot be made smaller. In the configuration described above, when the transporting belt is stopped, since the transporting belt is stopped at a rotation position that is different from the initial rotation position, the above situation can be averted.

The printing apparatus described above may further include a pressing unit that is disposed on the upstream side of the print head in the transport direction and that presses the outer surface of the transporting belt.

With the configuration described above, the pressing unit pressing the transporting belt can suppress the transporting belt from rising up. Accordingly, even if curls are formed in the initial wound portions, the rising up of the initial wound portions can be suppressed.

In the printing apparatus described above, the transporting belt may transport the medium while in a state in which the medium is electrostatically attracted to the transporting belt, and the pressing unit may be a discharging unit that removes an electric charge from a print surface of the medium by coming in contact with the print surface of the medium electrostatically attracted to the outer surface of the transporting belt.

With the configuration described above, by removing the electric charge from the print surface of the medium with the discharging unit (the pressing unit), the reduction in the electrostatic attraction force exerted to the medium from the transporting belt can be suppressed.

In the printing apparatus described above, a contact pressure of the discharging unit against the transporting belt may be adjustable.

With the configuration described above, when there is a need to remove the electric charge from the print surface of the medium, such as when performing printing on the medium, the contact pressure can be set high and, on the other hand, when there is no need to remove the electric charge from the print surface of the medium, such as when printing is not performed on the medium, the contact pressure can be set low. Accordingly, when there is no need to perform discharge on the print surface of the medium, a state in which the contact pressure is low continues such that deterioration (deformation, for example) of the discharging unit can be suppressed.

In the printing apparatus described above, the pressing unit may be a pressing roller in which a direction in which a rotation axis thereof extends is the width direction.

With the configuration described above, since the pressing roller can be rotated upon transportation of the medium, compared with a configuration in which the pressing unit does not rotate, the friction between the medium and the pressing roller can be reduced. Accordingly, the surface of the medium can be avoided from being easily damaged.

What is claimed is:

1. A printing apparatus comprising:

a plurality of belt rollers that rotate, a direction in which a rotation axis of each belt rollers extends being a width direction that intersects a transport direction of a medium;

a transporting belt that, while wound across the plurality of belt rollers, rotate to transport the medium in the transport direction;

a print head that performs printing on the medium transported by the transporting belt; and a control unit that, while in a state in which an unrotated state of the transporting belt has continued for a predetermined period, rotates the transporting belt, wherein, in the transporting belt, when portions in which the plurality of belt rollers are wound around when power is applied are referred to as initial wound portions, the control unit adjusts, in accordance with the positions of the initial wound portions in a rotating direction of the transporting belt, a belt transport start timing in which the transporting belt starts the transportation of the medium, and wherein, when, in a circulating route of the transporting belt, an interval between adjacent initial wound portions is referred to as a reference interval, in a case in which printing is performed on the medium having a length in the transport direction that is shorter than the reference interval, the control unit adjusts the belt transport start timing such that the medium is transported to a portion between the adjacent initial wound portions.

2. The printing apparatus according to claim 1, wherein, in a case in which printing is performed on a medium having a length in the transport direction that is equivalent to or longer than the reference interval, the control unit adjusts the belt transport start timing such that, from when the transporting belt starts the transportation of the medium until when the transportation thereof is ended, the medium is transported so that a number of the initial wound portions of the transporting belt in contact with a back surface of the medium becomes fewer.

3. A printing apparatus comprising:

a plurality of belt rollers that rotate, a direction in which a rotation axis of each belt rollers extends being a width direction that intersects a transport direction of a medium;

a transporting belt that, while wound across the plurality of belt rollers, rotate to transport the medium in the transport direction;

a print head that performs printing on the medium transported by the transporting belt; and a control unit that, while in a state in which an unrotated state of the transporting belt has continued for a predetermined period, rotates the transporting belt, wherein, in the transporting belt, when portions in which the plurality of belt rollers are wound around when power is applied are referred to as initial wound portions, the control unit adjusts, in accordance with the positions of the initial wound portions in a rotating direction of the transporting belt, a belt transport start timing in which the transporting belt starts the transportation of the medium, and wherein, when, in a circulating route of the transporting belt, an interval between adjacent initial wound portions is referred to as a reference interval, in a case in which printing is performed on a medium having a length in the transport direction that is equivalent to or longer than the reference interval, the control unit adjusts the belt transport start timing such that, from when the transporting belt starts the transportation of the medium until when the transportation thereof is ended, the medium is transported so that a number of the initial wound portions of the transporting belt in contact with a back surface of the medium becomes fewer.

4. A printing apparatus comprising:

a plurality of belt rollers that rotate, a direction in which a rotation axis of each belt rollers extends being a width direction that intersects a transport direction of a medium;

a transporting belt that, while wound across the plurality of belt rollers, rotate to transport the medium in the transport direction;

a print head that performs printing on the medium transported by the transporting belt; and a control unit that, while in a state in which an unrotated state of the transporting belt has continued for a predetermined period, rotates the transporting belt, wherein, in the transporting belt, when portions in which the plurality of belt rollers are wound around when power is applied are referred to as initial wound portions, the control unit adjusts, in accordance with the positions of the initial wound portions in a rotating direction of the transporting belt, a belt transport start timing in which the transporting belt starts the transportation of the medium, and in a case in which a print job in which a print area and anon-printing area arranged in the transport direction is formed on the medium is input, the control unit adjusts the belt transport start timing such that, from when the transporting belt starts the transportation of the medium until when the transportation thereof is ended, the medium is transported so that a number of the initial wound portions of the transporting belt in contact with a surface on an opposite side of a print surface on which the print area is formed becomes fewer.

* * * * *